US007841483B2

(12) United States Patent
Bisca et al.

(10) Patent No.: US 7,841,483 B2
(45) Date of Patent: Nov. 30, 2010

(54) DOUBLE CAP SYSTEM FOR THE HANDLING AND TRANSFER OF HAZARDOUS MATERIALS

(75) Inventors: Analia Bisca, Capital Federal (AR); Ruben Coronel, Carlos Spegazzini (AR); Victor Homberger, Glew (AR); Andrea Quinteros, Muniz (AR)

(73) Assignee: Comision Nacional de Energia Atomica, Capital Federal (AR)

( * ) Notice: Subject to any disclaimer, the term of this patent is extended or adjusted under 35 U.S.C. 154(b) by 766 days.

(21) Appl. No.: 11/787,421

(22) Filed: Apr. 16, 2007

(65) Prior Publication Data

US 2007/0284016 A1 Dec. 13, 2007

(30) Foreign Application Priority Data

Apr. 25, 2006 (AR) ..... P060101652

(51) Int. Cl.
*B65D 51/18* (2006.01)

(52) U.S. Cl. ..... 220/254.7

(58) Field of Classification Search ..... 220/254.8, 220/254.7, 254.1, 795, 789, 780, 806, 796, 220/325, FOR. 203, 826, 810, 260, 360, 23.89, 220/23.88, 200; D34/7, 1; 292/137, 163, 292/DIG. 11, 146, 150, 277
See application file for complete search history.

(56) References Cited

U.S. PATENT DOCUMENTS 1,229,912 A * 6/1917 Doncaster ..... 220/592.23
1,929,761 A * 10/1933 Thwaits ..... 220/314
1,939,139 A * 12/1933 Schott ..... 220/263
2,112,465 A * 3/1938 Maish ..... 220/495.08
4,043,482 A * 8/1977 Brown ..... 220/783
4,570,816 A * 2/1986 Ferris et al. ..... 220/314
4,580,694 A * 4/1986 Hempelmann et al. ... 220/256.1
4,809,873 A * 3/1989 Fossey ..... 220/324
5,105,966 A * 4/1992 Fort et al. ..... 220/327
5,660,295 A * 8/1997 Hroma et al. ..... 220/324
5,857,308 A * 1/1999 Dismore et al. ..... 53/50
5,931,330 A * 8/1999 Starr ..... 220/254.3
6,095,365 A * 8/2000 Yielding ..... 220/264
6,276,552 B1 * 8/2001 Vervisch ..... 220/324
6,296,135 B1 * 10/2001 Anderson et al. ..... 220/203.23
2008/0257888 A1 * 10/2008 Lee ..... 220/324

FOREIGN PATENT DOCUMENTS

DE 1954811 6/1997
DE 19548118 A1 * 6/1997
GB 2330549 4/1999
GB 2330549 A * 4/1999

* cited by examiner

*Primary Examiner*—Anthony Stashick
*Assistant Examiner*—Robert J Hicks
(74) *Attorney, Agent, or Firm*—Defillo & Associates, Inc.; Evelyn A. Defillo

(57) ABSTRACT

This invention relates to a system of double cap for the handling and transferring of hazardous materials between two vessels containing radioactive or toxic materials or pathogenic microorganisms. The system of the present invention includes a particular metal-metal sealing embodied between the cap and flange of a first container or water-tight compartment, and the cap and flange of a second container.

12 Claims, 8 Drawing Sheets

DOUBLE CAP SYSTEM FOR THE HANDLING AND TRANSFER OF HAZARDOUS MATERIALS

FIELD OF THE INVENTION

The present invention pertains to a "Double cap system for the handling and transfer of hazardous materials" between two vessels, for radioactive or toxic materials, or for materials containing pathogenic microorganisms. This system comprises a particular metal-metal contact sealing between a cap and a flange of a first vessel or a water-tight compartment, and a cap and flanges of a second vessel, the latter being a 200-liter standardized vessel or barrel.

DESCRIPTION OF THE PRIOR ART

The aim of the double cap systems is to prevent, during the transfer of some hazardous materials between two vessels, any leakage to the atmosphere or the environment surrounding such vessels. For that reason, the caps of both vessels are coupled, leaving external surfaces facing each other and making up the "double cap" as used herein. Subsequently, said double cap or coupled caps are opened by means of an opening/closing electropneumatic mechanism, located within one of the vessels, which places the double cap apart from the hazardous materials transfer opening.

Once the double cap is removed, the vessels remain connected through their openings and the transfer between vessels can be carried out in the direction needed. Once said hazardous material is transferred between vessels, the opening/closing electropneumatic mechanism places the double cap back to where it was removed from, and the two caps thereof are then uncoupled so that each cap is placed in its respective vessel.

As shown herein, when this procedure is carried out, the external surfaces of the caps, or surfaces in contact with the environment, do not get polluted thanks to their mutual hermetic coupling, in spite of having remained in one of the vessels.

In addition, there will not be any leakage in the coupling of the vessels either, that is to say, in the loading and unloading opening of the material to be transferred.

These double cap systems are preferably applied to the transfer of material from a waste container or barrel to a water-tight compartment, such as a glove box or a waste treatment cell, or vice versa.

To ensure total security in the procedure, certain operations must be performed in the correct order, for example, the door to the water-tight compartment or cell must not be opened until the second vessel has been coupled, or until both caps have been coupled to each other.

With reference to the prior art of the present invention, double cap systems are known, as disclosed in U.S. Pat. No. 5,857,308 (AEA TECHNOLOGY PLC) dated Jan. 12, 1999, GB 2,330,549 (KARLSRUHE FORSCHZENT) dated Apr. 28, 1999, DE 1954811.8 (KARLSRUHE FORSCHZENT-DE) Jun. 26, 1997, and U.S. Pat. No. 4,580,694 (KERNFORSCHUNGSZ KARLSRUHE-DE) dated Apr. 8, 1986. The disadvantage of these systems over the present invention lies in the use of a sealing method consisting solely of a rubber joint with no metal-metal contact, which means that, in case the joint gets damaged by aging, chemical reaction with a material or fire, stagnation is lost and the material contained is released to the atmosphere or environment.

The double cap of the invention has a sealing by metal—metal contact with rubber gaskets. It utilizes two square gaskets of equal sections and dimensions, of microalveolar or closed cell rubber, arranged in such a way that they touch only in their edges of one of its apices.

Consequently, it presents the advantage of a simple cross section of the gaskets, the sealing is achieved by compression since microalveolar rubber is utilized, and it allows the absorption of disalignments between the flanges, without loosing hermeticism, and with less quality requirements in the mechanization. The location of the gaskets in the flanges and doors are built with two retention wings in order to fix the gaskets in their_position without the need to use adhesives and therefore allowing an easy maintenance or replacement of the gaskets without the necessity of removing or opening the doors.

Neither of the patents above mentioned provide a solution to the problem of sealing in a simple and safe way, which is achieved in the present invention through a metal-metal contact which is coupled with two gaskets of square sections and they are placed face to face by the edges of one of its apices of the section, minimizing in that way the possible polluted area.

Another characteristic of the double cap of the invention is the doors lock, which consists of a minimum of three bolts which allows to play the double function of unlocking the drum cap and, at the same time, of coupling both caps hermetically. Consequently, in general this system is simpler than the systems mentioned in the prior art.

Another disadvantage of the previous art systems is that a special vessel or barrel must be used, as well as complex, specifically designed rubber gaskets, so no other container can be used. Moreover, the simple manufacture square-section gasket used herein results in lower system production costs.

Furthermore, in the systems of the prior art, the rubber gasket is stressed by weight, unlike the system of the present invention wherein the gasket is only stressed by weight when the caps are coupled.

SUMMARY OF THE INVENTION

The double cap of the present invention overcomes the problems and/or drawbacks of the systems of the prior art by means of a particular structure of the water-tight compartment, vessel or barrel caps and flanges thereof, which enables the formation of metal-metal seals which are complemented with microalveolar or closed cell rubber gaskets with simple shape and with lineal contact between them, preventing leakages to the outside, even when the rubber gaskets are subject to poor use conditions.

The two gaskets of square sections of microalveolar rubber confronted by one of their edges, minimize the possible pollution area. This is possible thanks to its capacity to present differences regarding flatness and because of its design and disposition.

The placements of the gaskets in the flanges and door cap are designed with two retention wings that fix the gaskets in their position, avoiding the use of other fixing methods like adhesives. This method allows to make the maintenance or replacement of the gaskets easier without the need to retire or open the caps.

The use of flanges applied to the vessel or barrel enables the use of other types of barrels and only the flange that adapts to each type needs to be changed.

There is also electro pneumatic activation with a pneumatic piston for the opening and closing of the double cap which is monitored by sensors associated to electronic logic, so as to ensure the correct operation sequence of the pneumatic actuators, preventing the compartment cap from opening when the container is uncoupled and thus from polluting the environment.

One of the main objectives of the present invention is to ensure water-tight sealing during the handling and transfer of hazardous materials and to ensure long-lasting elements, preventing its watertight nature from being damaged by aging.

The second objective of the present invention is to achieve the water-tight sealing of each one of the caps once they are placed in the corresponding containers.

The third objective of the double cap system is to facilitate the use of any container suitable for the handling and transfer of hazardous materials by means of the coupling of flanges, which shall be compatible with the water-tight compartment cap the material transfer is performed with.

A particular application of the present invention is the handling and transfer of hazardous materials such as radioactive or toxic materials or pathogenic microorganisms.

BRIEF DESCRIPTION OF THE DRAWINGS

To achieve a better understanding of the present invention and its advantages, below is a detailed description of a preferred example of the formulation of the double cap presented herein, based on the attached drawings, wherein.

DETAILED DESCRIPTION OF THE INVENTION

Figure 1:
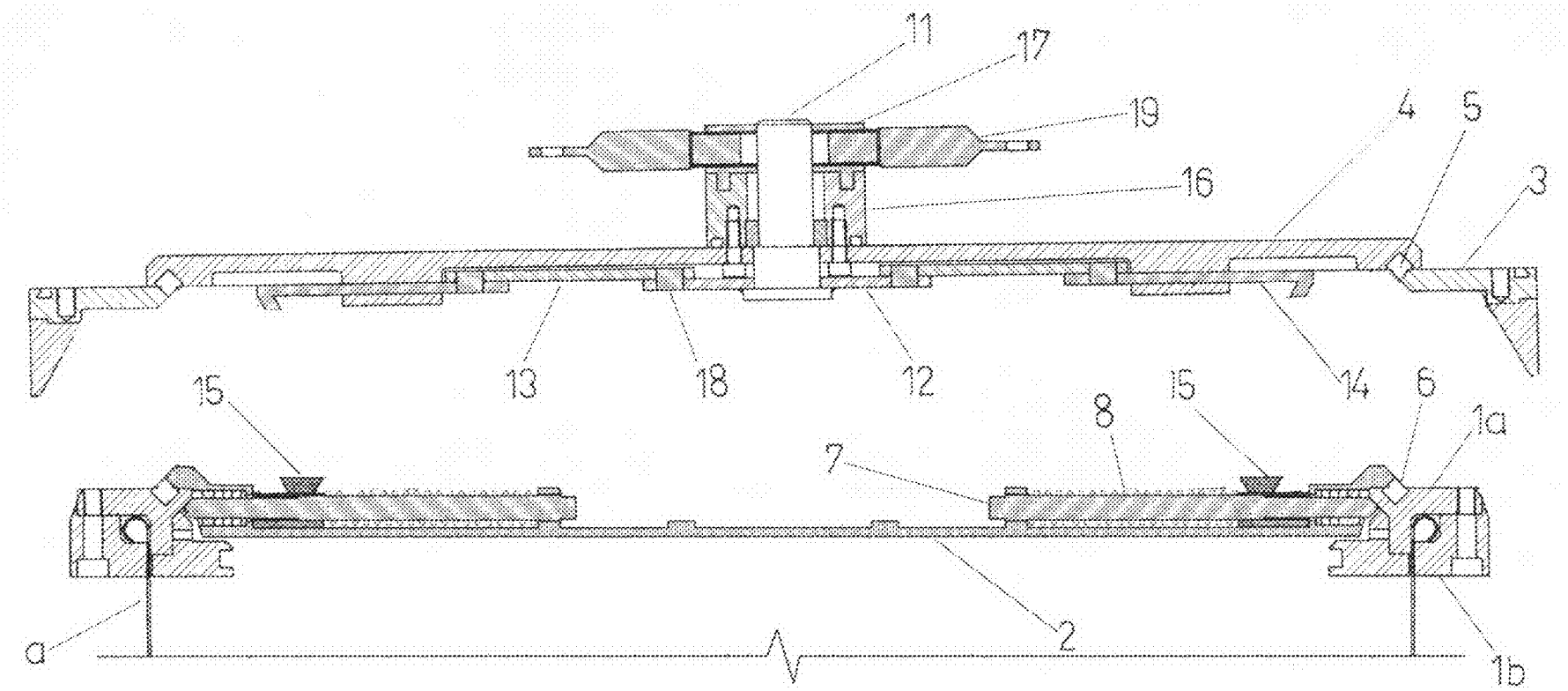
FIG. 1 shows a sectional view of the set of water-tight compartment cap (upper part) placed in the compartment itself over the corresponding flange, and the vessel or barrel cap with the flanges fastening it to the corresponding barrel (lower part), prior to the contact of the barrel with the water-tight compartment, in accordance with a method of production of the present invention.

FIG. 1 shows a sectional view of the set of water-tight compartment cap (upper part) placed in the compartment itself over the corresponding flange, and the vessel or barrel cap with the flanges fastening it to the corresponding barrel (lower part), prior to the contact of the barrel with the water-tight compartment, in accordance with a method of production of the present invention.

Figure 2:
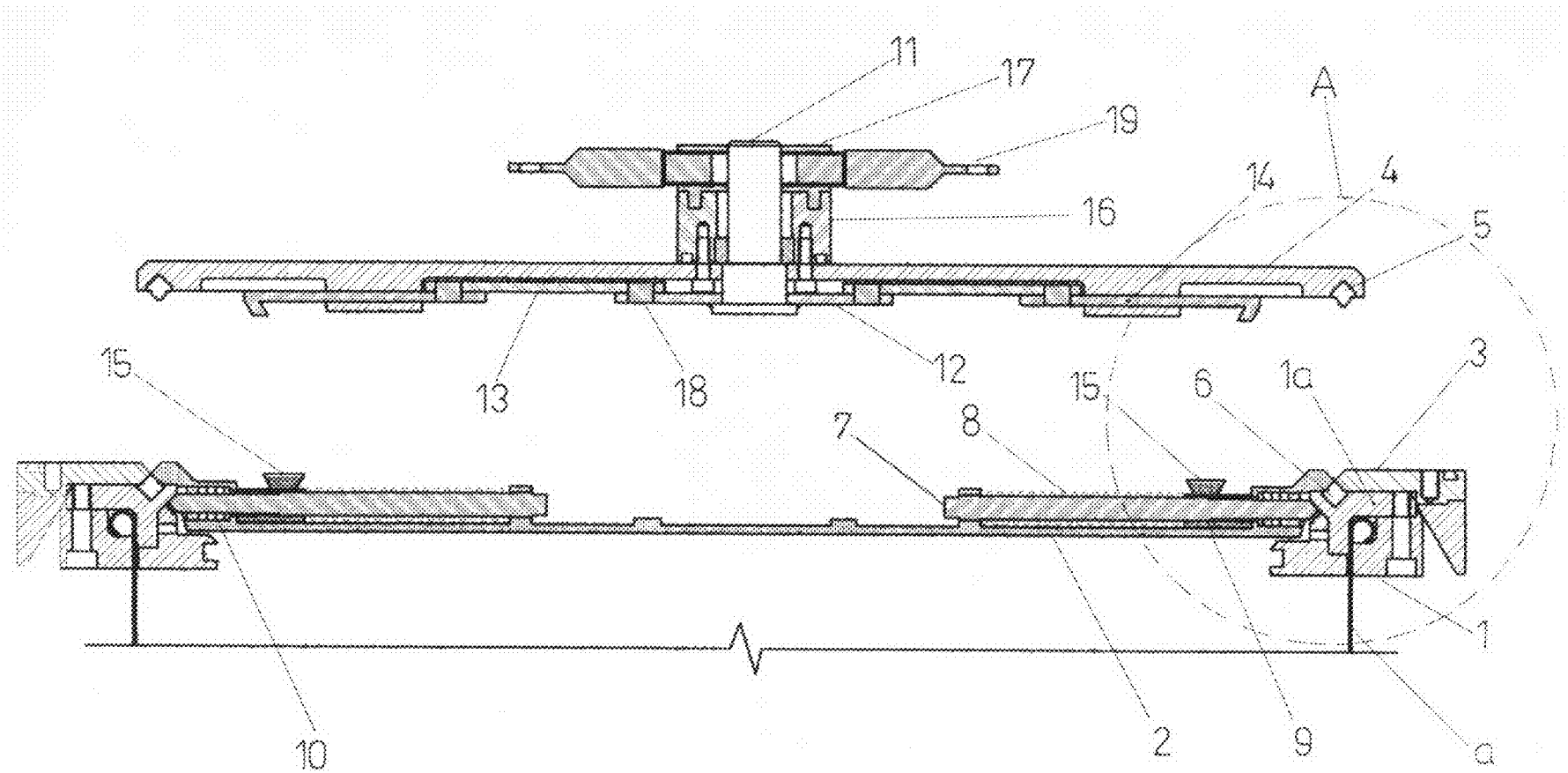
FIG. 2 shows a sectional view of the set of barrel cap and water-tight compartment or closed cell cap, where the water-tight compartment cap is represented apart from its flange and the cap of the vessel, in accordance with the method of production of FIG. 1.

FIG. 2 shows a sectional view of the set of barrel cap and water-tight compartment or closed cell cap, where the water-tight compartment cap is represented apart from its flange and the cap of the vessel, in accordance with the method of production of FIG. 1.

Figure 3:
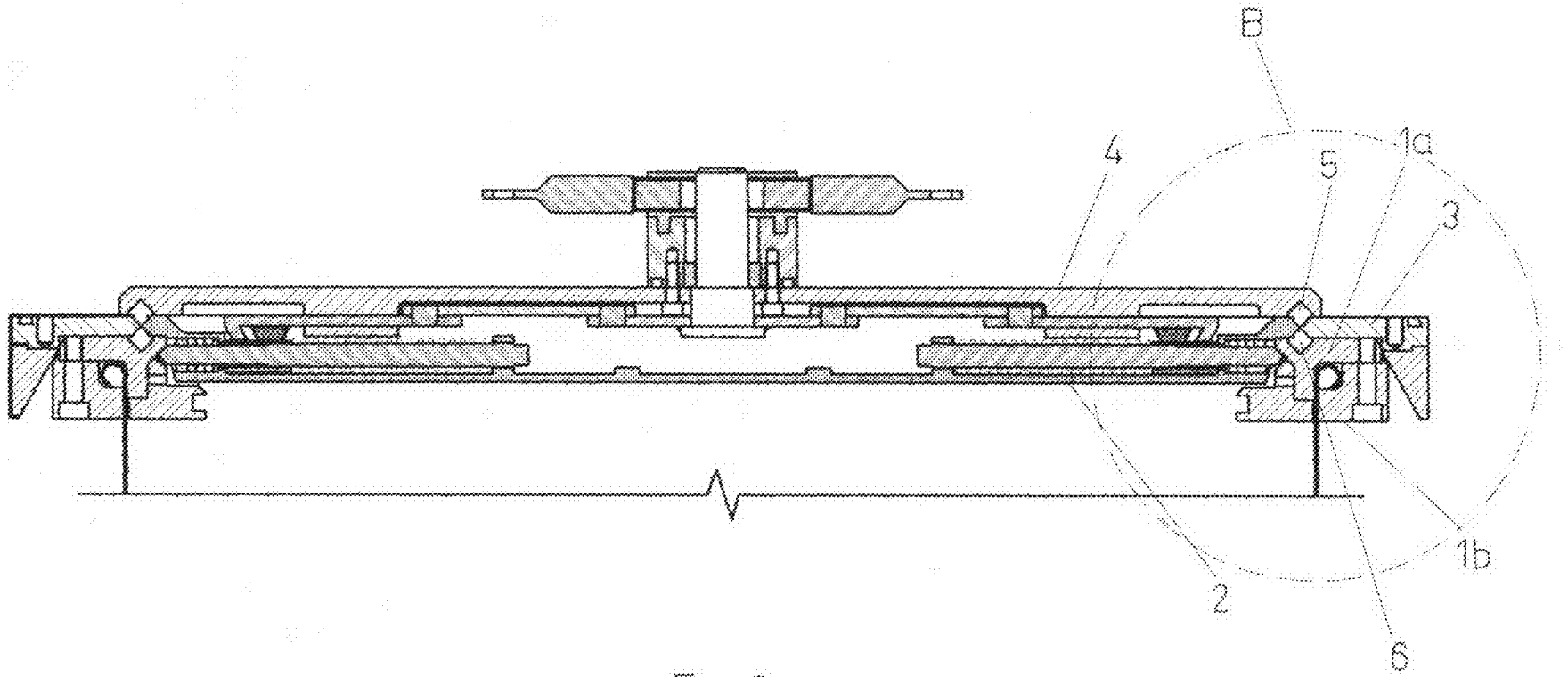
FIG. 3 shows a sectional view of the set of barrel cap and compartment cap in contact position, prior to the coupling of the caps, in accordance with a method of production of the present invention.

FIG. 3 shows a sectional view of the set of barrel cap and compartment cap in contact position, prior to the coupling of such caps, in accordance with a method of production of the present invention.

Figure 4:
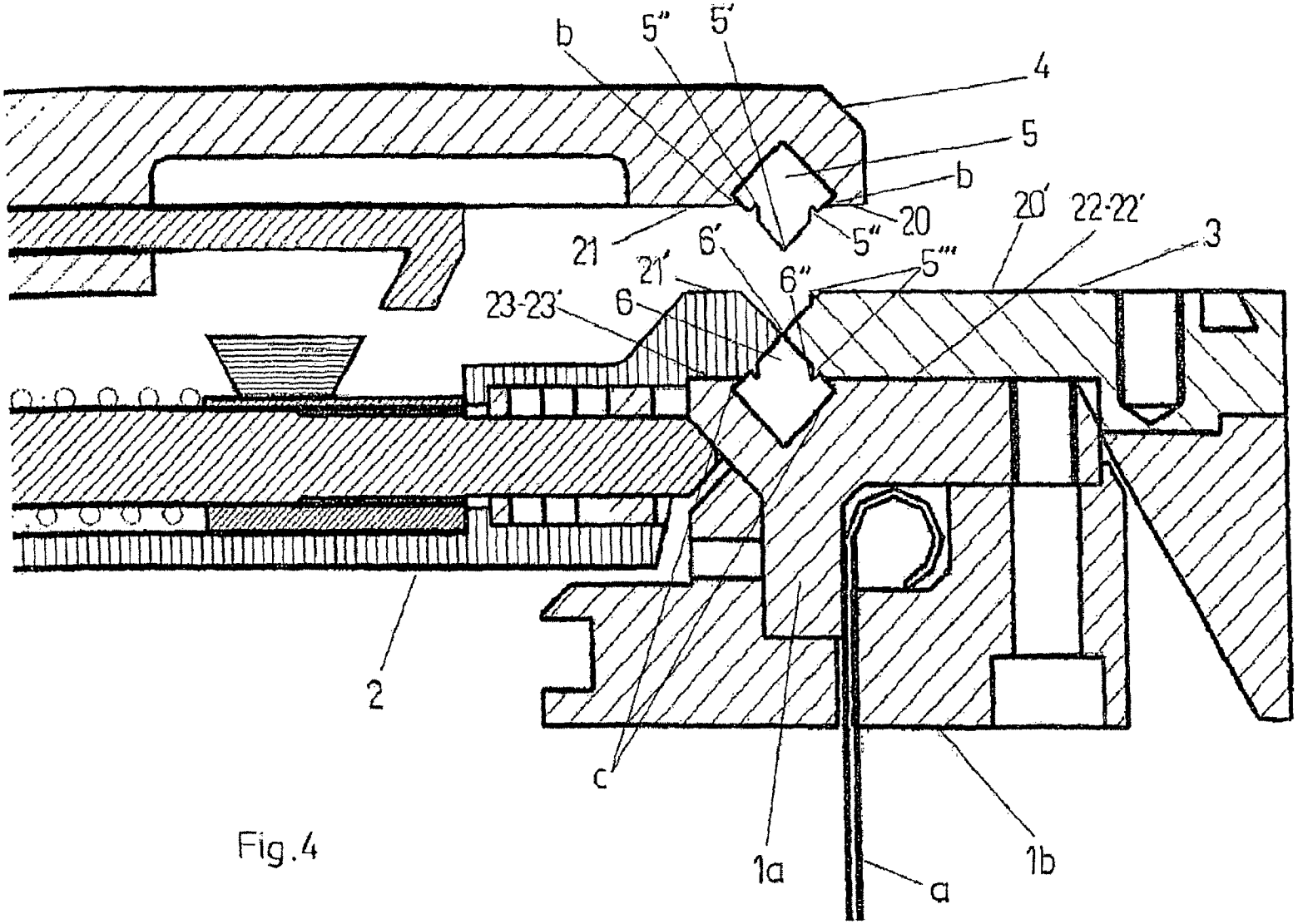
FIG. 4 shows detail view of section A of FIG. 2; where the sealing system can be observed, which includes both gaskets of square section of microalveolar rubber (closed cell rubber) confronted by their edges, and the gasket placement in the flanges in the door cap, with two retention wings that fix the gaskets in their position.

FIG. 4 shows detail A of FIG. 2.

Figure 5:
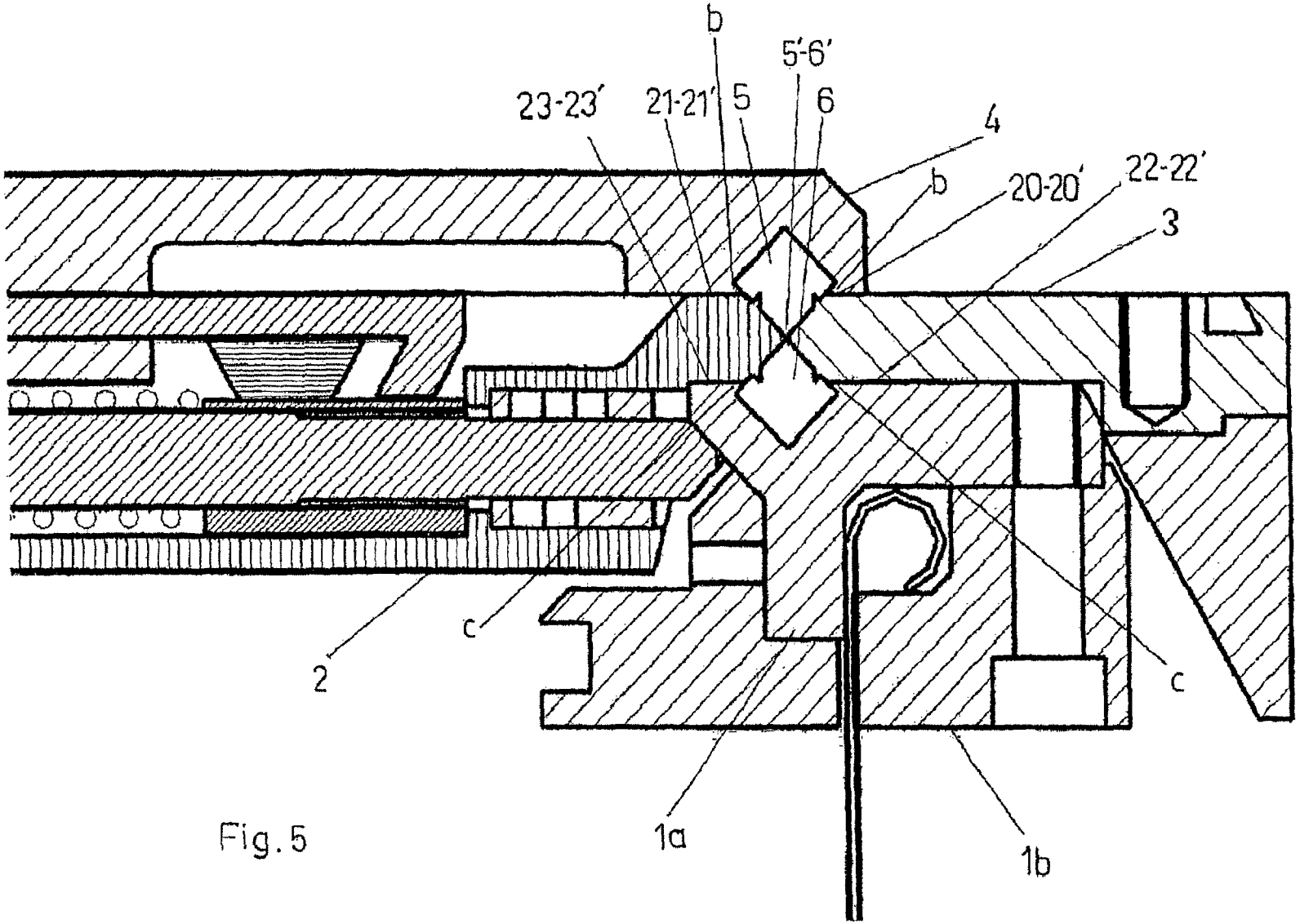
FIG. 5 represents detail view of section B of FIG. 3; where the system of sealing by metal-metal contact can be observed, plus the two equal square gaskets of microalveolar rubber confronted by their edges, and the gasket placements in the flanges in the door cap, with two retention wings that fix the gaskets in their position.

FIG. 5 represents detail B of FIG. 3.

Figure 6:
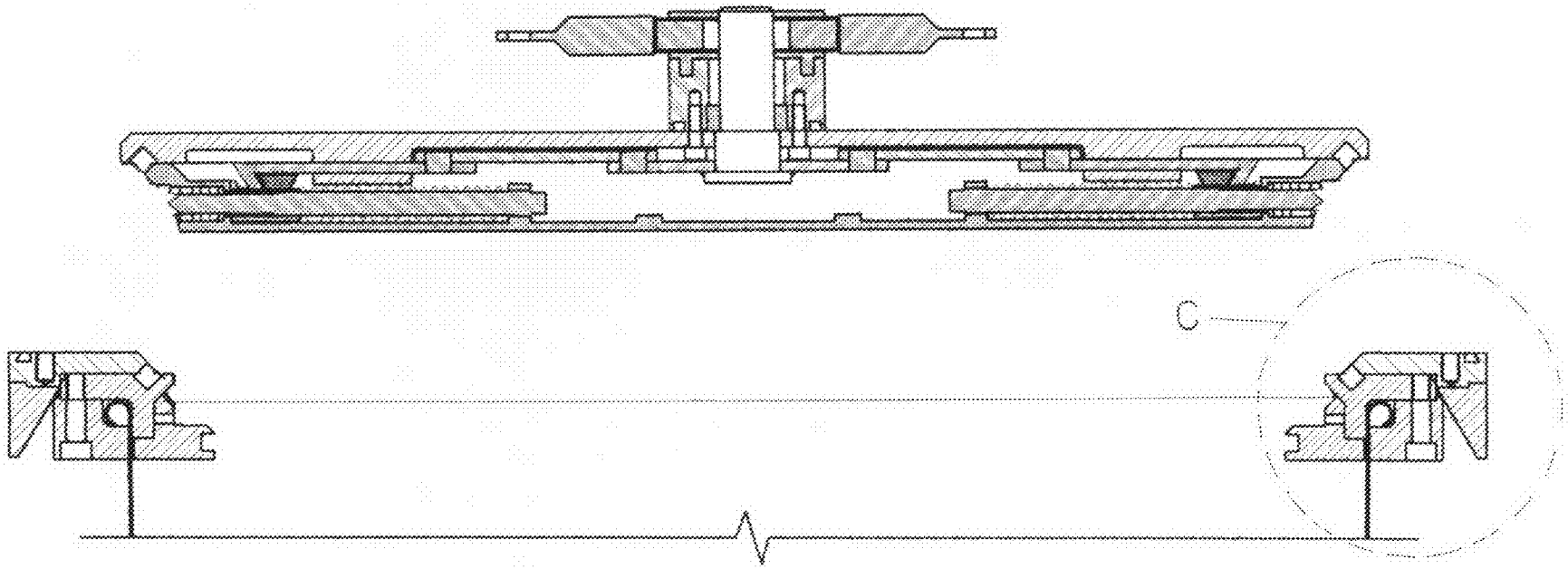
FIG. 6 shows the double cap system of the present invention, uncoupled from the opening of the water-tight compartment or cell, which compartment has already the container or barrel coupled to it.

FIG. 6 shows the double cap system, uncoupled from the opening of the water-tight compartment or cell, which compartment has already the container or barrel coupled to it.

Figure 7:
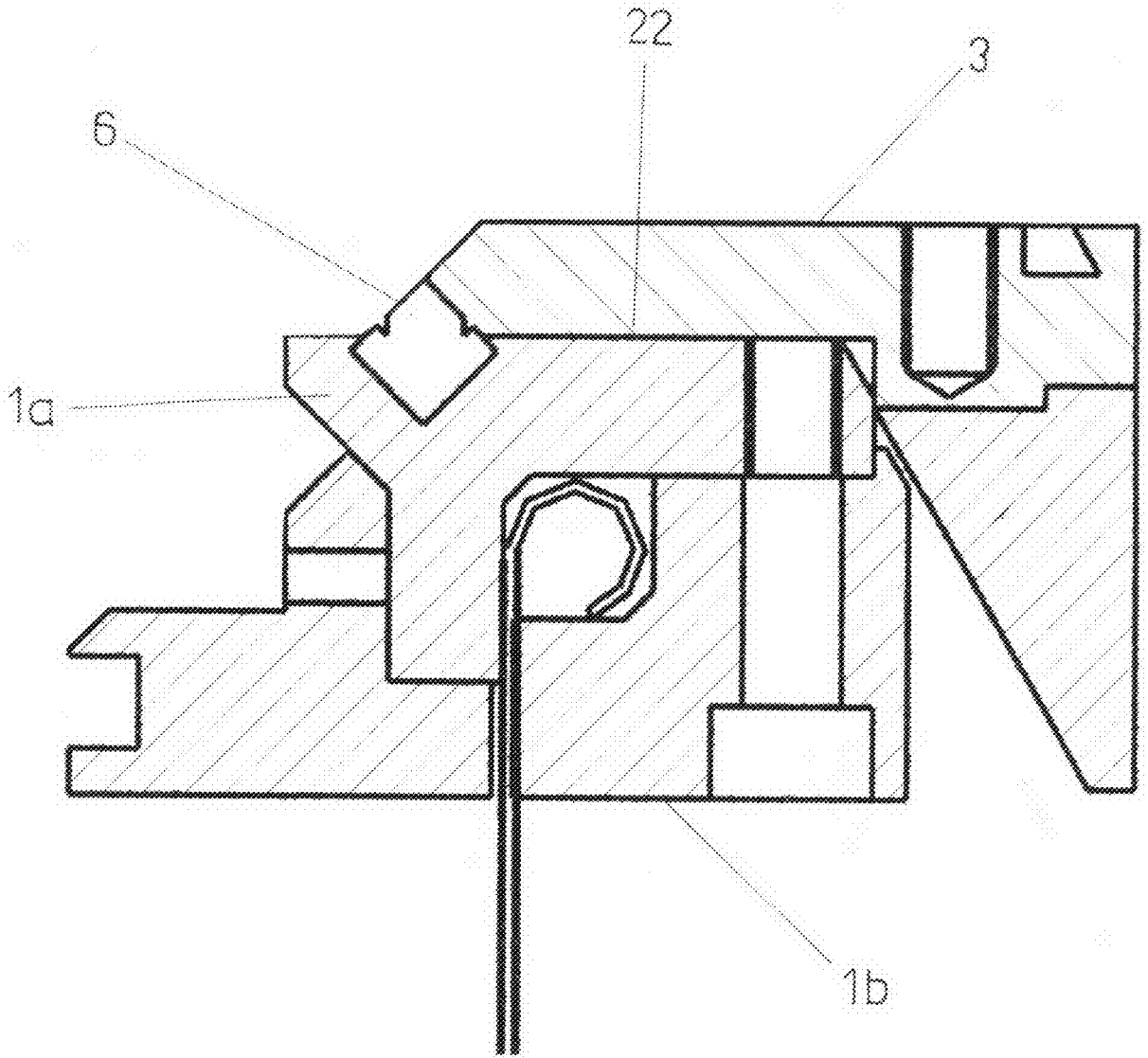
FIG. 7 shows detail view of section C of FIG. 6.
Figure 8:
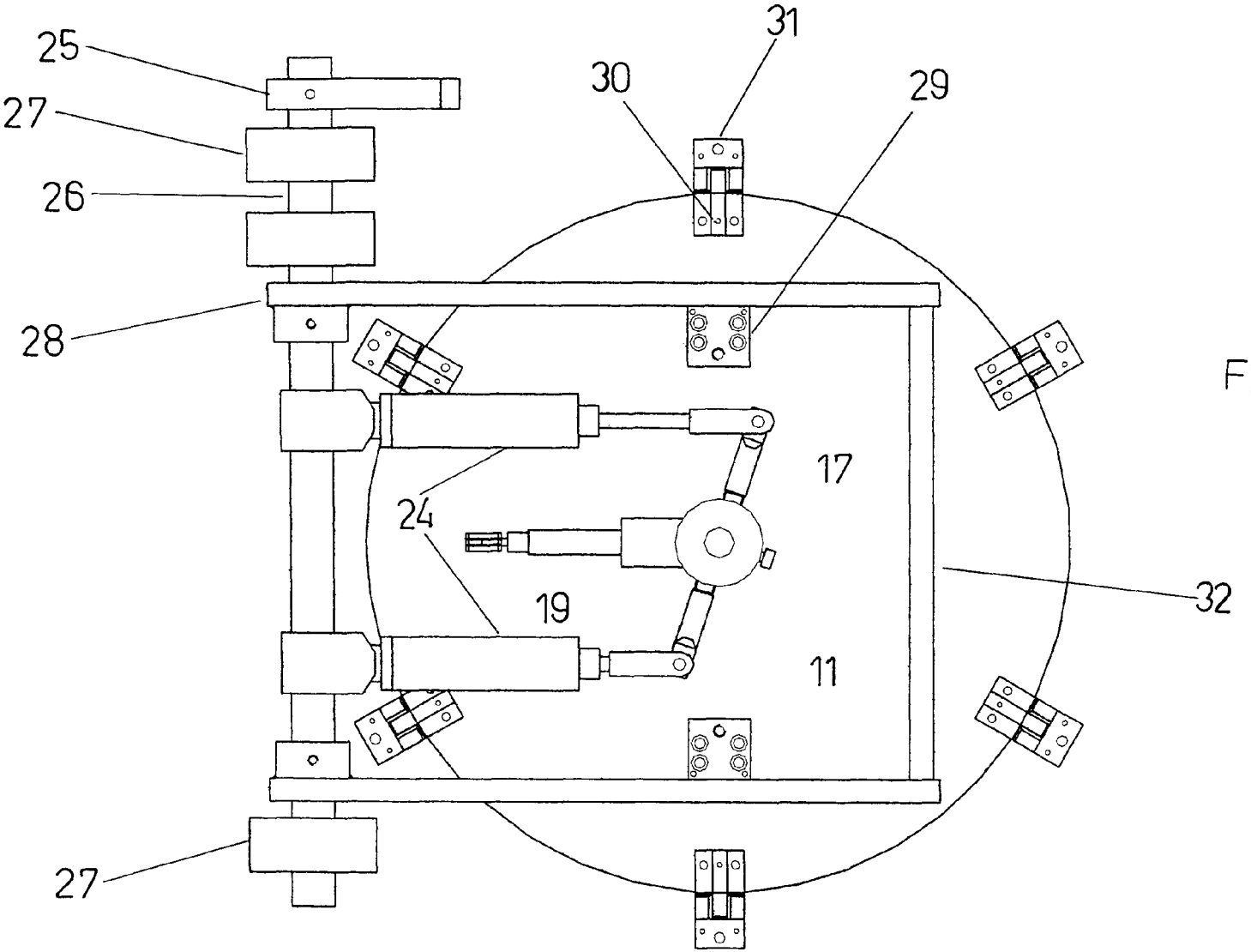
FIG. 8 shows the activation mechanism for the coupling of the barrel and cell or water-tight caps, and for the elevation of the double cap.

FIG. 7 shows detail C of FIG. 6;

FIG. 8 shows the activation mechanism for the coupling of the barrel and cell or water-tight caps, and for the elevation of the double cap.

In the figures listed above, equal or equivalent components of the example of the invention execution correspond to equal reference numbers.

As shown in FIG. 4, the present invention comprises a double cap system wherein the coupling constitutes a metal-metal sealing by means of contact of 20, 20" and 21, 21" circular areas belonging to the water-tight compartment 4 cap, to the container or barrel 2 cap and flange 3 of the water-tight compartment cap. The sealing is completed with two gaskets of equal square sections 5 and 6 of microalveolar rubber confronted by their edges 5'-6' which are formed by their apices, so that a linear contact is produced among them, minimizing in this way the possible pollution area.

In addition, there shall be a metal-metal sealing between the lower surface (22) of flange 3, and the upper outer surface (22') of flange 1*a* of the container or barrel "a"; and between the container or barrel cap (23') and the upper inner surface (23) of flange 1*a*.

It is also observed in FIGS. 4 and 5, that each placement of the gaskets 5 and 6 present in the flanges 1*a* and in the cap 4 retention wings "b" and "c", which fix the gaskets 5 and 6 in their position.

Also, FIGS. 1 to 7 show the use of flanges 1*a* and 1*b* placed in container or barrel "a"; flanges adaptable to any container "a", including a standardized 200-liter barrel and flange 3 placed over the wedge surface of the water-tight compartment cap 4.

The barrel flange 1*a* and the cell or water-tight compartment cap 4 have microalveolar rubber gaskets housing 5 and 6, preferably square section, in order to achieve a hermetic seal among cap 4, water-tight compartment flange 3 and cap 2, and among barrel flange 1*a*, water-tight compartment flange 3 and container or barrel cap 2.

As shown in FIGS. 4 and 5, metal-metal seals can be found between water-tight compartment cap 4 and flange 3 (contact area 20, 20"); between barrel flange 1*a* and water-tight compartment flange 3 (contact area 22, 22"), between barrel flange 1*a* and cap 2 (contact area 23, 23") and between barrel cap 2 and water-tight compartment cap 4 (contact area 21, 21").

The designs known in the prior art use rubber gaskets placed directly over the specially designed barrel, which consequently has the same diameter, and cannot be used with other containers. The container or barrel flange structures presented herein enable a safe transfer of hazardous materials without the need of special containers, so that standardized 200-liter barrels can be used for storing radioactive or dangerous waste.

The operation sequence of the double cap system is as follows:

Elevation of barrel "a" comprising flanges 1*a* and 1*b*, under the set of gate or cap 4 of the water-tight compartment or waste cell "b" comprising flange "3";

Positioning of barrel "a" in flange 3 of the water-tight compartment or waste cell so that the lower part of rubber seal 5 placed on cap 4 of the compartment lies properly on the corresponding wedge of cap 2 of container or barrel "a".

Coupling, by means of internal mechanisms of the water-tight compartment, of cap 4 to cap 2 of container or barrel "a" (segments 14 of cap mechanism 4 lock to wheels 15. When such segments are moved towards the center, cap 2 is opened and coupled to cap 4).

Elevation, with the subsequent opening of the double cap and free access to the inside of the barrel, for loading or unloading.

In the preferred embodiment, cap 2 of barrel "a" locks onto the barrel by means of six bolts (7) with springs (8) which, at the time of closing cap 2, are inserted in a notch existing on flange 1*a* of barrel "a".

Bolts 7 are tightened onto cap 2 by means of a thread in the locking die (9). Three retainers (10) are used to seal the bolt outlet hole.

Once cap 2 of the barrel and barrel "a" itself have been coupled to flange 3 of the water-tight compartment, cap 2 of the barrel must be unlocked to be coupled to cap 4 of the water-tight compartment, and thus enable the caps to be elevated and removed from the opening of the compartment to freely communicate the container or barrel and the water-tight compartment.

This mechanism is made up of a central axis (11) with a disk (12) united to the latter. Twelve piston rods (13) are attached to the disk (12) by means of bolts (18) and each to a segment (14). Two pneumatic pistons (24), see FIG. 8, activate the sleeves (19), which are threaded to the central piece 17 and which rotates jointly with the central axis (11). The piece (16) by means of which cap 4 is fastened is placed under the central axis (11) and makes both the disk (12) and the piston rods (13) rotate as well. When piston rods (13) rotate, the segments (14) move towards the center of the cap in a radial fashion. As the latter move, the segments are fitted to the tapered wheels (15) and move the locking die (9) and the bolt (7) towards the center of the cap compressing the spring (8) and releasing the bolt (7) from the notch in the barrel flange.

Thus, cap 2 is unlocked from container or barrel "a" and coupled to cap 4 of the water-tight compartment between the segments (14) and the tapered wheels (15).

Once caps 2 and 4 are coupled, they are raised by means of a pneumatic piston. As shown in FIG. 8, this piston activates the main piston rod (25) which makes the axis (26) placed over three bearings (27) rotate. The main hinges (28) are fixed to the water-tight compartment cap through the pieces (29) and connected to each other by means of the bar (32). The hinges rotate together with the axis (26) to elevate the double cap.

Cap 4 of the water-tight compartment comprises six bolts (30) placed equidistantly, as shown in FIG. 8, which, when closed, enable the correct positioning of the cap by means of the guides (31).

To ensure the correct order of operations, the air cylinders have sensors to indicate the position of the embolus. In addition, the system has sensors to indicate if the barrel is coupled to the flange of the water-tight compartment and if both caps are coupled to each other. All sensors are associated to an electronic logic, for example a PLC, to ensure that no step of the operation sequence is performed until the previous step is completed. Electronic logic prevents the cap from opening if the barrel is not coupled to the water-tight compartment, the water-tight compartment cap from opening if it is not coupled to the barrel cap, the barrel cap from uncoupling while the water-tight compartment cap is open, and the barrel from being removed while the double cap is open or when the barrel cap has not been locked to the flange thereof.

Any system operation can also be performed manually, for which purpose they have special pieces that enable this operation by means of telemanipulators.

The invention claimed is:

1. A double cap system for the handling and transfer of hazardous materials, comprising:

a first cap (4) of a first container, the first cap including a first gasket (5) and a first metallic flange (3);

a second cap (2) of a second container (a) coupled to the first cap, the second cap having a second metallic flange (1*a*) that contains a second gasket (6) and a third metallic flange (1*b*);

wherein both caps are made of metallic materials that couple to form the double cap;

wherein the first metallic flange (3) and the second and third metallic flanges are mutually coupled;

wherein a metal-metal sealing contact is defined between the first cap (4) and the first flange (3), between second flange (1*a*) and the first flange (3), between second flange (1*a*) and second cap (2), and between second cap (2) and the first cap (4);

wherein the first gasket (5) and the second gasket (6) are of elastomeric material with microalveolar internal structure and have polygonal sections including vertexes; and wherein the first gasket (5) and the second gasket (6) are coupled face to face by the edges of one of its vertex (5', 6') forming a linear contact between them.

2. The double cap system for the handling and transfer of hazardous materials according to claim 1, wherein said gaskets (5, 6) are of square transverse sections.

3. The double cap system for the handling and transfer of hazardous materials according to claim 2, wherein the first gasket (5) and the second gasket (6) include at least two retention wings (b, c) respectively, wherein the retention wings (b, c) allow to fix the gaskets (5, 6) in their position.

4. The double cap system for the handling and transfer of hazardous materials according to claim 1, wherein said cap (4) of the first container has two annular perimetral surfaces (20, 21) between which said first gasket (5) is located;

wherein the cap (2) of the second container has an annular surface in its periphery edge that when coupled to the first cap (4) makes contact with the annular perimetral surface of the first cap.

5. The double cap system for the handling and transfer of hazardous materials according to claim 1, wherein said first container is a water-tight compartment or waste cell.

6. The double cap system for the handling and transfer of hazardous materials according to claim 1, wherein the coupling between both caps is made through a mechanism comprising of a central axis (11) in the first cap with a disc (12) fixed to it, to which at least six piston rods (13) are connected through bolts (18), and each of said piston rods (13) are connected to a segment (14); and wherein said mechanism has socket elements (15) in the second cap and when the disc (12) is turned the piston rods (13) are moved, making the segments (14) move in a radial form towards the center of the first cap; said socket elements (15) are fitted, carrying out the coupling between both caps.

7. The double cap system for the handling and transfer of hazardous materials according to claim 6, wherein said socket elements (15) are tapered wheels and said piston rods (13) are equal to the quantity of said segments (14), and said tapered wheels (15).

8. The double cap system for the handling and transfer of hazardous materials according to claim 7, wherein each of said socket elements (15) of the second cap are connected to a locking die (9) and to a coupling bolt (7), connected said bolt to elastic means, so that when the segments (14) of the first cap move, the locking die (9) and the coupling bolt (7) move towards the cap center, releasing the bolt (7) of the lock in the flange of the second container, carrying out the uncoupling between the second container and the second cap.

9. The double cap system for the handling and transfer of hazardous materials according to claim 1, wherein said second container is a 200-liter barrel.

10. The double cap system for the handling and transfer of hazardous materials according to claim 6, wherein said second container is a 200-liter barrel.

11. A double cap system for the handling and transfer of hazardous materials, comprising:

a first cap (4) of a first container, the first cap including a first gasket (5) and a first metallic flange (3);

a second cap (2) of a second container (a) coupled to the first cap, the second cap having a second metallic flange (1*a*) that contains a second gasket (6) and a third metallic flange (1*b*);

wherein both caps are made of metallic materials that couple to form the double cap;

wherein the first metallic flange (3) and the second and third metallic flanges are mutually coupled;

wherein a metal-metal sealing contact is defined between the first cap (4) and the first flange (3), between second flange (1*a*) and the first flange (3), between second flange (1*a*) and second cap (2), and between second cap (2) and the first cap (4);

wherein the first gasket (5) and the second gasket (6) are of elastomeric material with microalveolar internal structure and have square sections including vertexes;

wherein the first gasket (5) and the second gasket (6) are coupled face to face by the edges of one of its vertex (5', 6') of the square section forming a linear contact between them;

wherein the first gasket (5) and the second gasket (6) include at least two retention wings (b, c) respectively, wherein the retention wings (b, c) allow to fix the gaskets (5, 6) in their position;

wherein said cap (4) of the first container has two annular perimetral surfaces (20, 21) between which said first gasket (5) is located;

wherein the cap (2) of the second container has an annular surface in its periphery edge that when coupled to the first cap (4) makes contact with the annular perimetral surface of the first cap; and wherein the coupling between both caps is made through a mechanism comprising of a central axis (11) in the first cap with a disc (12) fixed to it, to which at least six piston rods (13) are connected through bolts (18), and each of said piston rods (13) are connected to a segment (14); and wherein said mechanism has socket elements (15) in the second cap and when the disc (12) is turned the piston rods (13) are moved, making the segments (14) move in a radial form towards the center of the first cap; said socket elements (15) are fitted, carrying out the coupling between both caps.

12. The double cap system for the handling and transfer of hazardous materials according to claim 1, wherein said first container is a water-tight compartment or waste cell.

* * * * *